US008478173B2

(12) United States Patent
Daloia et al.

(10) Patent No.: US 8,478,173 B2
(45) Date of Patent: Jul. 2, 2013

(54) LIMITED OZONE GENERATOR TRANSFER DEVICE

(75) Inventors: Gerald F Daloia, Webster, NY (US); Michael A Doody, Manchester, NY (US); Daniel Barroso, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 328 days.

(21) Appl. No.: 13/030,220

(22) Filed: Feb. 18, 2011

(65) Prior Publication Data

US 2012/0213561 A1 Aug. 23, 2012

(51) Int. Cl.
*G03G 15/20* (2006.01)

(52) U.S. Cl.
USPC ..... 399/311

(58) Field of Classification Search
USPC ..... 399/310, 311, 121, 170
See application file for complete search history.

(56) References Cited

U.S. PATENT DOCUMENTS

| | | | | |
|---|---|---|---|---|
| 3,847,478 | A | 11/1974 | Young | |
| 5,781,829 | A * | 7/1998 | Wong et al. | 399/91 |
| 6,033,452 | A | 3/2000 | Fina et al. | |
| 7,398,035 | B2 * | 7/2008 | Zona et al. | 399/168 |
| 8,335,450 | B1 * | 12/2012 | Daloia et al. | 399/96 |
| 2005/0265750 | A1 * | 12/2005 | Blair et al. | 399/170 |
| 2012/0321347 | A1 * | 12/2012 | Daloia et al. | 399/128 |

* cited by examiner

*Primary Examiner* — Walter L Lindsay, Jr.
*Assistant Examiner* — Rodney Bonnette

(57) ABSTRACT

A limited ozone generator transfer device includes a ceramic substrate having conducting lines, a dielectric layer, and a top conducting layer with slots therein that align with the underlying conducting lines. Corona is generated in the slots by applying an AC voltage of about 2.5 kVp-p across the electrodes. This device is "green" in that it generates significantly less ozone than conventional transfer devices, thus reducing requirements on an ozone collection system.

16 Claims, 4 Drawing Sheets

LIMITED OZONE GENERATOR TRANSFER DEVICE

BACKGROUND

1. Field of the Disclosure

The present disclosure relates generally to a system for transfer of charged toner particles in an electrostatographic printing apparatus, and more particularly, concerns a non-contact limited ozone producing transfer device used in such a machine.

2. Description of Related Art

Typically, in an electrostatographic printing process of printers, such as, U.S. Pat. No. 6,033,452, which is incorporated herein by reference to the extent necessary to practice the present disclosure, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface, which is usually a photoreceptor. The toner powder image is then transferred from the photoconductive member to a copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

Transfer is typically carried out by the creation of a "transfer-detack zone" (often abbreviated to just "transfer zone") of AC and DC biases where the print sheet is in contact with, or otherwise proximate to, the photoconductive member. A DC bias applied to the back (i.e., on the face away from the photoconductive member) of the paper or other substrate in the transfer zone electrostatically transfers the toner from the photoconductive member to the paper or other substrate presented to the transfer zone. The toner particles are heated to permanently affix the powder image to the copy substrate. Biased transfer rolls are also used to transfer an image from a photoconductive member to media, for example, the segmented bias roll disclosed in U.S. Pat. No. 3,847,478.

These traditional image transfers are done using charging devices which produce ozone and apply pressure directly to a transfer media to remove the image from a photoconductive member. Removal of this ozone has traditionally been done utilizing extensive air handling systems that add additional cost into the printer.

Thus, there is a need for a transfer device that: reduces the amount of air systems needed to remove ozone; eliminates the transfer system media pressure contact; and reduces the degradation of components in the transfer systems.

BRIEF SUMMARY

In answer to this need, provided hereinafter is a limited ozone generator transfer device that includes sequential layers of a ceramic substrate, conducting lines, a dielectric layer, and a top conducting layer having slots therein that align with the underlying conducting lines. Corona is generated in the slots by applying an AC voltage of about 2.5 kVp-p across the dielectric. This device is "green" in that it generates significantly less ozone than conventional transfer devices, thus reducing the requirements on the ozone collection system.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, media, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
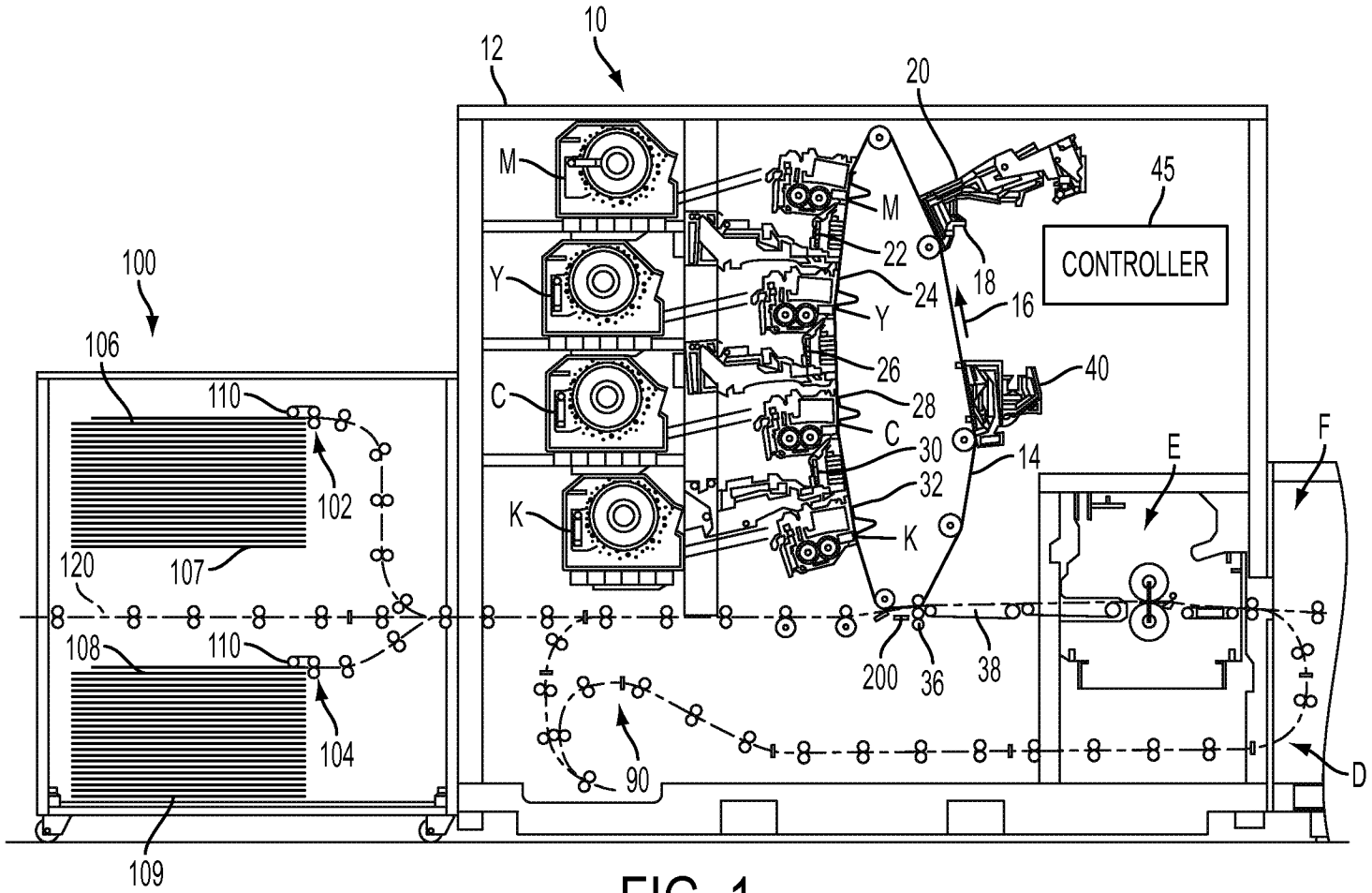
FIG. 1 is a partial, frontal view of an exemplary modular xerographic printer that includes the limited ozone generator transfer device of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method and apparatus for limiting ozone creation while transferring toner to a media.

For a general understanding of the features of the disclosure, reference is made to the drawings. In the drawings, like reference numerals have been used throughout to identify identical elements.

Referring now to printer 10 in the figure, as in other xerographic machines, and as is well known, shows an electrographic printing system including the improved method and apparatus for reducing ozone generation during transfer on images from an imaging member to a media source in accordance with the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, etc., which performs a print outputting function for any purpose. Marking module 12 includes a charge retentive substrate which could be a photoreceptor belt or photoconductive member 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives sheets from sheet feeder module 100 and brings the sheets into contact with the image on belt 14. Sheet feeder module 100 includes high capacity feeders 102 and 104 with feed heads 110 that feed sheets from sheet stacks 106 and 108 positioned on media supply trays 107 and 109 and directs them along sheet path 120 to imaging or marking module 12. Additional high capacity media trays could be added to feed sheets along sheet path 120, if desired.

Limited ozone generator transfer device 200 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

Figure 2:
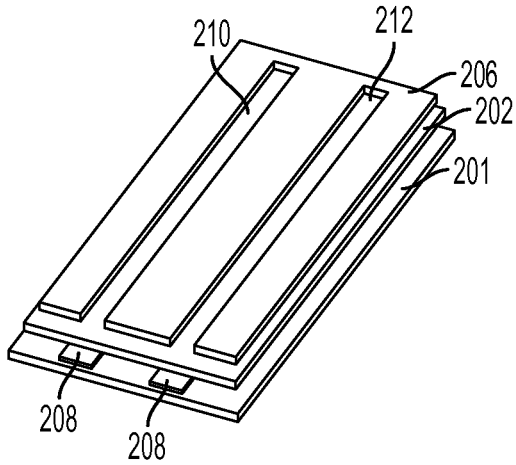
FIG. 2 is perspective view of the limited ozone generator transfer device in accordance with the present disclosure used in the printing apparatus of FIG. 1.

With reference to FIG. 2, and in accordance with the present disclosure, a method and apparatus for limiting the amount of ozone produced by a "green" limited ozone generator transfer device in printer 10 is disclosed that includes a hybrid thick film apparatus 200 comprising a ceramic substrate 201 that supports a dielectric layer 202 positioned between two conductive layers 206 and 208. Conductive layer 206 includes slots 210 and 212 therein while conductor 208 is in the form of two conductive strips with the two conductive strips underlying the slots 210 and 212 of the upper electrode. Corona generation is created within the slots 210 and 212. The non-contact thick film device 200 is placed in close proximity to and below transfer media and aligned directly below photoconductive surface 14. Energizing conductive layers 206 and 208 charges the transfer media, thus moving the toner latent image from the photoconductive surface 14 and placing the image on the media. The electrical power necessary to energize the transfer system is selected in order to create the transfer charge and thermal energy necessary to increase the ozone decay rate, but well below the thermal limit to degrade the transfer media.

Figure 3:
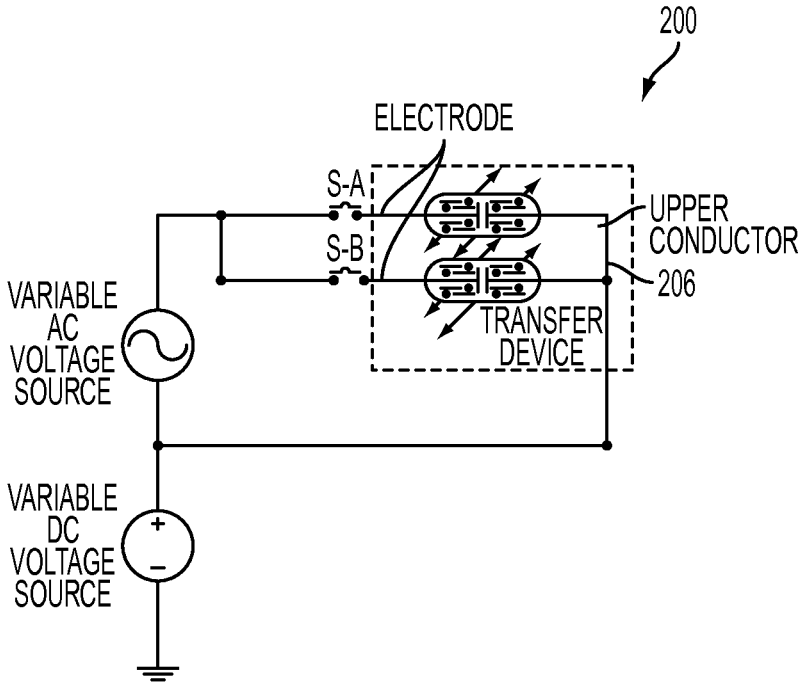
FIG. 3 is an electrical schematic for controlling ion production of the electrodes shown in FIG. 2.

The electrical schematic in FIG. 3 depicts transfer device 200 in a 2 line operational mode. Each line has one electrode (lower conductor) and all electrodes have a common upper conductor (FIG. 2). The number of electrodes is dependent upon the transfer device application and the ceramic substrate's physical dimensions and the amount of power needed for the application.

The transfer device's selected materials allow for the thick film circuit to handle AC and DC voltages as high as 3000 volts. For testing, the ceramic material was chosen to have a 1650 mm2 charging area. The ceramic's rigidity permits the device to be suspended under the transfer belt, while being supported at the ends.

Switch S-A controls the AC high voltage delivered to the first electrode while switch S-B delivers the AC high voltage to the 2nd electrode. Operation of the transfer device required the AC voltage to be greater than 1800 volts in order to strike corona. The upper conductor is connected to the variable DC voltage supply.

Corona generation occurs when the electrodes are subject to AC high voltage. The electrical fields that surround the electrodes cause the air molecules to ionize on the surface of the dielectric between the upper conductor fingers in slots 210 and 212 (FIG. 2). The upper conductor is further energized to a DC voltage which establishes and controls the charge on transfer media.

The ions from the ionized air molecules are repelled to the transfer media. The upper conductor's structure being even and rigid across transfer device 200 assures uniformity of the charge across the transfer media. The charged transfer media attracts the toner from the surface of the rotating photoconductive member in FIG. 1. The strength of the corona and upper conductor voltage allows the transfer device to be placed up to 3 mm from the underside of the transfer media. No contact with the transfer media or photoconductive member is required as with a bias transfer roll.

Figure 4:
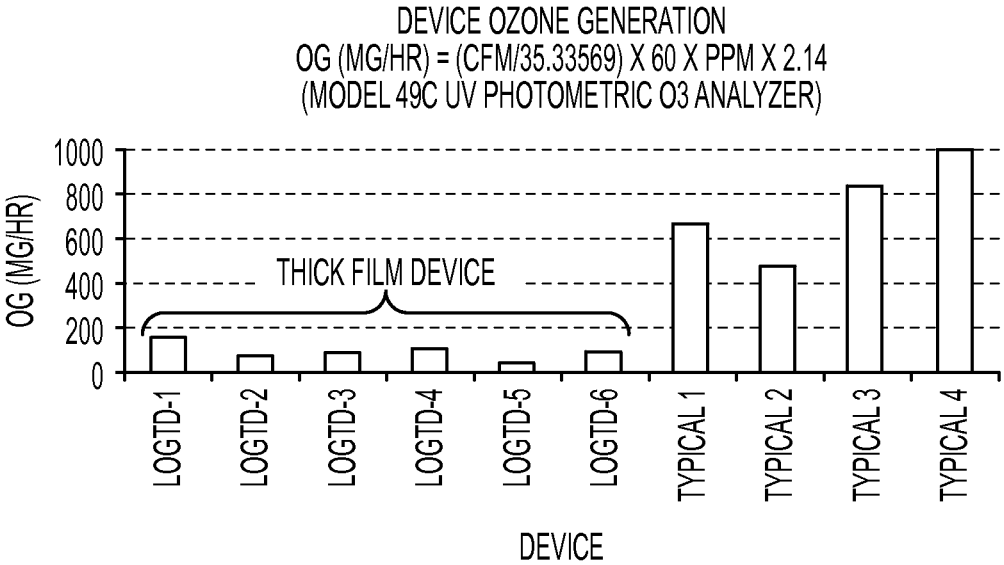
FIG. 4 is a chart showing ozone production for different transfer devices.

As shown in the chart of FIG. 4, during corona generation, the structure of the thick film mechanism is such that the ceramic substrate will achieve temperatures near 1000 C. At these temperatures, the ozone produced by corona generation will diminish due to the increase in the ozone decay rate. The ceramic and the surface conductor's physical, chemical and electrical characteristics are not degraded due to the high temperatures. As continuous high AC voltage is applied to the electrodes and the corona is maintained at the appropriate application level the ozone level will be well below 200 mg/hr, while typical transfer devices (1-4) maintain ozone levels equal to or above 400 mg/hr.

Figure 5:
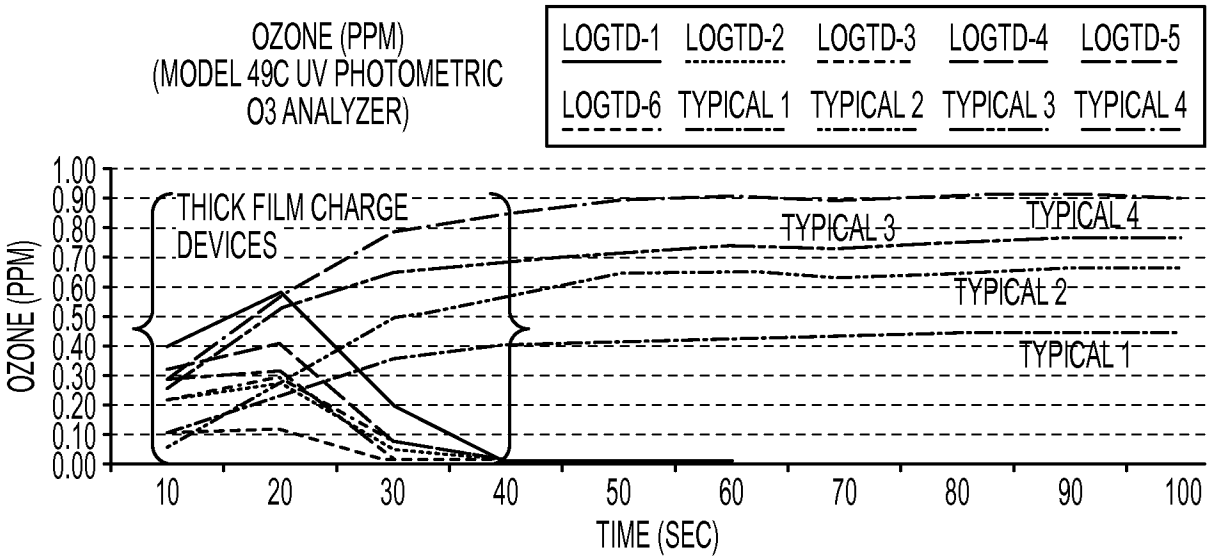
FIG. 5 is a chart comparing the limited ozone generator transfer device of the present disclosure with typical transfer devices.

The chart in FIG. 5 compares in parts per million (ppm) vs. time the ozone level of the limited ozone generator transfer device 200 with typical transfer devices over time. As shown, the low ozone generator transfer device's ozone level will reduce to below 0.03 ppm within about 40 seconds, while in contrast; typical charge devices will continue to emit ozone requiring air handlers, ozone resistant metals, seals and bushings.

It should be understood that while the disclosure has been described with reference to transferring images from a photoconductive member to sheets, it is equally contemplated that the limited ozone generator transfer device could be used to transfer toner from a photoconductive member to an intermediate transfer media.

In recapitulation, the embodiment of the present disclosure address a problem of traditional image transfers being done using transfer devices which produce unwanted quantities of ozone and apply pressure directly to a transfer media to remove an image from a photoconductive member. Disclosed herein is a transfer device that is "green" since it generates significantly less ozone than conventional transfer devices, thus reducing the requirements on the ozone collection system and cost since less costly ozone collection systems can be utilized. The limited ozone generator transfer device includes sequential layers of a ceramic substrate, conducting lines, a dielectric layer, and a top conducting layer having slots that align with the underlying conducting lines where corona is generated. Corona is generated by applying an AC voltage of about 2.5 kVp-p across the electrodes.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic device adapted to print an image onto a sheet, comprising:

an imaging apparatus for processing and recording an image onto said sheet;

an image development apparatus for developing the image;

a heaterless transfer device for transferring the image onto said sheet;

a fuser for fusing the image onto said sheet; and wherein said heaterless transfer device comprises a ceramic substrate with a lower conductor mounted thereon in the form of at least two conductive strips, a dielectric layer mounted on top of said lower conductor, and an upper conductor mounted on top of said dielectric layer and including at least two slots therein extending uninterrupted throughout a major length portion thereof, said at least two conductive strips positioned directly underneath said at least two slots within said upper electrode with corona generation being created within said at least two slots when said upper and lower conductors are energized.

2. The xerographic device of claim 1, including a circuit with a first switch adapted to be actuated to control AC voltage delivered to one of said conductors and a second switch adapted to be actuated to deliver AC voltage to the other of said conductors in order to produce corona generation within said at least one slot of said upper conductor.

3. The xerographic device of claim 2, wherein said upper conductor is energized to a DC voltage which establishes and controls charge on said sheet.

4. The xerographic device of claim 2, wherein said circuit operates with AC and DC voltages of up to 3000 volts.

5. The xerographic device of claim 1, wherein said heaterless transfer device is non-contact with respect to said sheet.

6. The xerographic device of claim 5, wherein said heaterless transfer device is positioned up to 3 mm away from said sheet.

7. A heaterless transfer device, comprising:

a ceramic substrate; and sequential layers on said ceramic substrate including two conducting lines thereon, a dielectric layer, and a top conducting layer including three fingers extending in a lengthwise dimension thereof with two slots therein between said three fingers that align with said conducting lines such that energizing of said conducting lines and said conductive layer causes corona generation within said two slots in said conducting layer.

8. The heaterless transfer device of claim 7, wherein corona is generated within said slots of said top conducting layer by applying an AC voltage of about 2.5 kVp-p across said conductive lines and said conductive layer.

9. The heaterless transfer device of claim 7, wherein said limited ozone generator transfer device is incorporated into a xerographic device.

10. The heaterless transfer device of claim 9, wherein said xerographic device includes an imaging member having an image thereon for transfer to a sheet, and wherein said ceramic substrate is adapted to be positioned up to 3 mm away from said sheet.

11. The heaterless transfer device of claim 10, wherein said ceramic substrate is positioned directly below said imaging member.

12. The heaterless transfer device of claim 7, wherein corona generation occurs when said conducting lines and conductive layer are subjected to AC high voltage.

13. A method for printing an image onto sheets, comprising:

providing an imaging apparatus for processing and recording an image onto said sheets;

providing an image development apparatus for developing said image;

providing a transfer device for transferring said image onto said sheet;

providing a fuser for fusing said image onto said sheet; and equipping said transfer device to include a ceramic substrate with a lower conductor of at least two conductive strips mounted thereon, a dielectric layer mounted on top of said lower conductor, and an upper conductor that includes at least three elongated members mounted on top of said dielectric layer, and wherein said at least three elongated members include at least two spaces therebetween extending the length of said at least three elongated members and positioned directly over and extending substantially throughout a lengthwise dimension of said at least two conductive strips such that corona generation takes place within and throughout said at least two spaces when said upper and lower conductors are energized.

14. The method of claim 13, including a circuit with a first switch adapted to be actuated to control AC voltage delivered to one of said conductors and a second switch adapted to be actuated to deliver AC voltage to the other of said conductors in order to produce corona generation within said slots of said upper conductor.

15. The method of claim 14, wherein said upper conductor is energized to a DC voltage which establishes and controls charge on said sheet.

16. The method of claim 13, wherein said transfer device is out of contact with respect to said sheet.

* * * * *